US005862532A

United States Patent [19]

Cain

[11] Patent Number: 5,862,532

[45] Date of Patent: Jan. 26, 1999

[54] QUICK SPRAY DISPENSER

[76] Inventor: Martin Cain, 7656 NW. 96 Ter., Tamarac, Fla. 33321

[21] Appl. No.: 850,988

[22] Filed: May 5, 1997

[51] Int. Cl.[6] ..... E03D 9/00

[52] U.S. Cl. ..... 4/228.1; 4/222; 4/223

[58] Field of Search ..... 4/228.1, 222, 223, 4/231; 222/162, 181.1, 181.2, 181.3, 183; 239/296, 337, 274

[56] References Cited

U.S. PATENT DOCUMENTS

| | | | |
|---|---|---|---|
| 2,795,799 | 6/1957 | Dickerman | 4/222 |
| 3,013,699 | 12/1961 | Meuwly | 4/228.1 |
| 3,068,492 | 12/1962 | Price | 4/222 |
| 3,143,745 | 8/1964 | Price | 4/222 |
| 4,056,228 | 11/1977 | Rosenkrantz et al. | 239/274 |
| 4,358,860 | 11/1982 | Church | 4/228.1 |
| 4,434,938 | 3/1984 | Rosenkrantz et al. | 239/274 |
| 4,625,342 | 12/1986 | Gangnath et al. | 4/228 |
| 5,184,761 | 2/1993 | Lee | 222/162 |
| 5,347,998 | 9/1994 | Hodson et al. | 222/162 |

*Primary Examiner*—David J. Walczak
*Attorney, Agent, or Firm*—Herbert L. Lerner; Laurence A. Greenberg

[57] ABSTRACT

A dispenser having a housing containing an aerosol spray can installed with its internal filling nozzle in a downward position. Activating a trigger will apply pressure to the bottom end of the can, and will press the can against a stop hole causing a deodorant spray to be released from the can and sprayed from a spray head into a toilet bowl.

A swing away cover allows for drop-in loading of a replacement can as required. The dispenser mounts on either side of a toilet tank with an optional toilet tissue holder to hold a spare roll of toilet tissue.

6 Claims, 2 Drawing Sheets

QUICK SPRAY DISPENSER

BACKGROUND OF THE INVENTION

FIELD OF THE INVENTION

The invention relates to a device for preventing bathroom odors.

Many attempts have been made to control the odor that is found in the bathroom. One prior art method requires a person to spray the entire area of a room with a deodorant. This method of controlling odors quickly uses up the contents of the can and covers the user's exposed body with chemicals used in the spray can. Many consumers do not use these types of spray cans due to this fact. Other prior art devices spray deodorant every time the toilet handle is pressed, even when no odor is being emitted from the toilet bowl. Other devices are too complex or expensive to be practical or have not worked effectively. An additional problem exhibited by some prior art devices is that they do not provide a convenient method for replacing a deodorant spray. Gangnath, U.S. Pat. No. 4,625,342, issued Dec. 2, 1986 discloses a dispenser which sprays deodorant into an area around the toilet tank each time the flush handle is pressed.

SUMMARY OF THE INVENTION

It is an object of the invention to provide a user with a simple device that will control odor emanating from a toilet bowl by spraying a deodorant over the open toilet bowl only when needed. The spray vapor will then confine the odor to the toilet bowl, and less deodorant will be consumed because the entire area of the room does not need to be sprayed. Spray will not be exposed to the user of this invention. The invention comprises a housing containing an aerosol spray can that can disperse a fragrance or deodorant.

The spray can is mounted upside down in the housing with the nozzle of the spray can resting against a stop hole in the housing. Pressure applied by the user on the bottom end of the can will release the deodorant spray into the housing's attached tubing and the deodorant spray will be dispersed by a spray head attached to the rear of a toilet bowl. The dispenser is designed with a large trigger area for easy use by children and older users where finger movement may be a factor in pressing on small triggers. The dispenser has a "swing-away" cover that pivots to allow the opening in the housing to be exposed for easy removal of a fully consumed spray can and insertion of a new spray can. The cover locks into place against a housing side cutout. The dispenser can be mounted on either side of a toilet tank and can be mounted on a toilet tank having a curved design. The dispenser has provisions for mounting a toilet tissue holder that slides into place on one or more sides of the housing. When the toilet tissue holder is installed a spare roll of toilet tissue is in reach at all times. The toilet tissue holder can be mounted on either side of the toilet tank with the dispenser. Clear tubing is used between the dispenser and the tubing spray holder and will allow the user to see when the spray is used up and when the spray can held within the dispenser needs replacement. My invention will allow a user to disperse less spray due to the small toilet bowl area. The combination of a hook, glue strips, and pressure applied by the tank cover will insure a secure mounting to the toilet tank. Using the alternate design cover in place of the "swing-away" cover will eliminate nine items and provide for retention of the can to the underside of the cover for easier handling of the spray can. The housing sides have to be sized for this use for clearance. Also, using this configuration of cover, different sized cans can be used in the dispenser. The dispenser is maintenance free and requires no internal cleaning.

It will be apparent that variations and modifications may be made within the scope of the claims, and portions of the improvements may be used without others.

DESCRIPTION OF THE PREFERRED EMBODIMENTS

Figure 1:
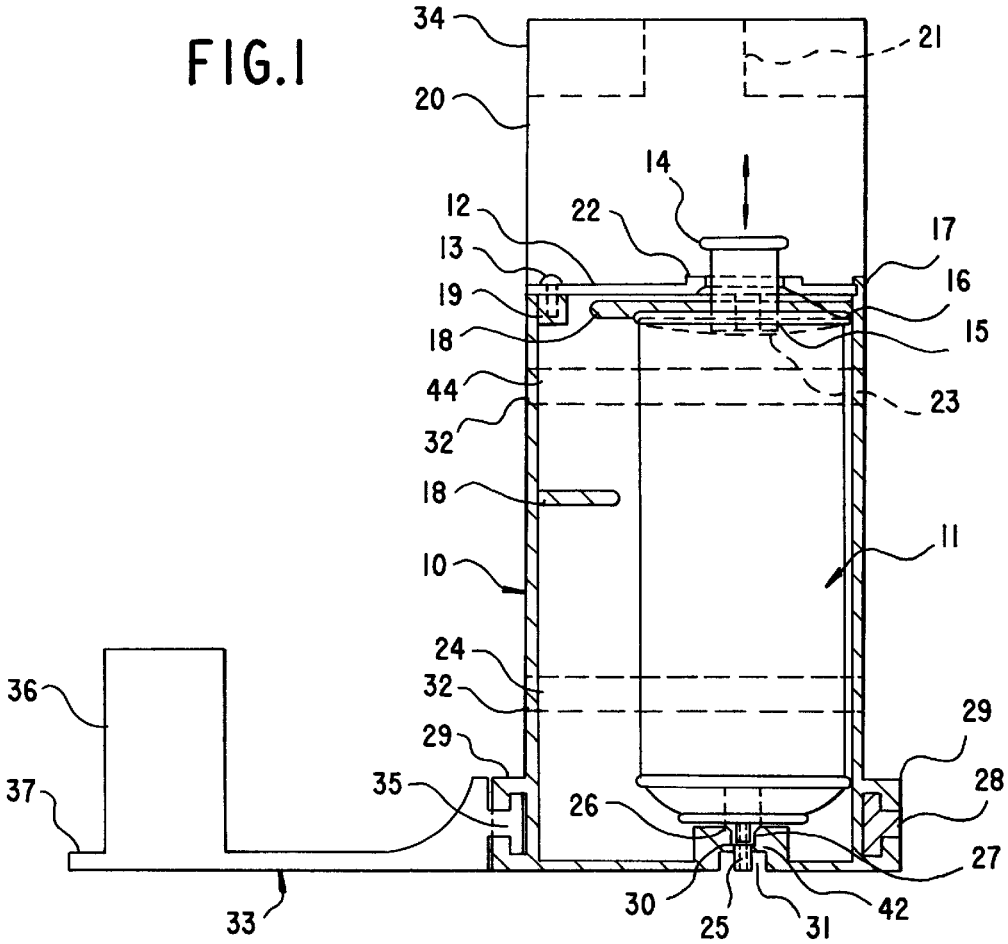
FIG. 1 is a vertical sectional view of a dispenser assembly.

FIG. 1 shows a cross-section of a dispenser housing 10. The housing 10 contains an aerosol spray can 11 held in a vertical position with its internal valve and nozzle 27 in a funnel hole 42. The nozzle 27 sits on a housing stop 30. The housing 10 has a cover 12 that rotates or "swings-away" to clear the spray can 11 for easy removal. Cover 12 rotates on a pivot 13 attached to a part 19 of the housing 10. A trigger 14 slides freely into a trigger guide 22 constructed as part of cover 12. A trigger stop end 15 is cleared to recess into a cutout 16 part of cover 12, when the trigger 14 is pulled in an up position to allow cover 12 to rotate past the housing side. Right side cutout 17 of housing 10 provides locking of cover 12 when closed. Trigger 14 on the assembly snaps into trigger guide 22 and cover 12 with the aid of cutout 23 for clearance. The housing 10 contains spray can guides 18 in predetermined places to assure spray can 11 alignment when dropping the spray can 11 into housing 10. The spray can guides 18 insure that the spray can 11 mates with nozzle stop 30. Extended section 20 of housing 10, has a formed hook area 34 sized to fit over a side of a toilet tank body. A cutout 21 of hook 34 allows flexing of the hook 34 as required to fit curved tanks. A spacer 24 part of housing 10 has a glue strip 32 to attach the housing 10 to the tank body. Tubing nozzle 25 part of the housing 10 is constructed with clearance 31 to allow for placement of tubing 48 (see FIG. 6) when installed. Spray can nozzle 27 fits easily into funnel opening 42 and bottoms on stop 30. Clearance is provided between can 11, at nozzle 27, and funnel 26 to allow movement of can 11 when pressed by trigger 14 to activate the can's internal valve 27. The spray vapor will release into stop 30 and into tubing nozzle 25. A spacer part 44 of the housing 10 and extension 20 move housing 10 away from under the tank cover overhang, keeping trigger 14 fully exposed for use. The housing 10 has formed toilet tissue holders 29 with cutouts 28 that mate with part 35 of a tissue holder 33. Holder 33 has a toilet tissue retainer 36 sized to fit a toilet tissue tube loosely. The end of the holder 33 has an overhang 37 to allow a tissue roll to sit level on holder 33. Holder 33 slides in place into a fitting 29 on either side of housing 10, with fit to assure retention.

Figure 2:
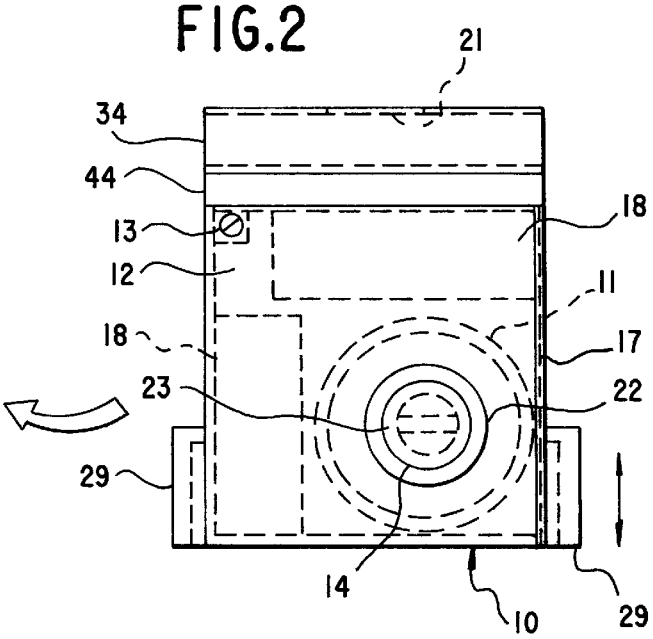
FIG. 2 is a vertical top view of the dispenser assembly which does not show a tissue holder.
Figure 3:
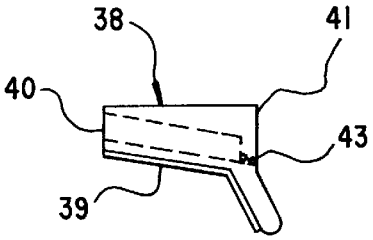
FIG. 3 is a horizontal side sectional view of a tubing holder.

FIG. 2 illustrates a top view of the cover 12. The optional tissue holder 33 is not shown. FIG. 3 shows a tubing holder 38 with a spray head end 41 containing a tubing blind hole

40 with spray holes 43 to produce a released spray vapor in a "blanket" spray over a toilet bowl. A glue strip 39 is provided that is double sided "water resistant" tape for retention of holder 38 to the toilet bowl.

Figure 4:
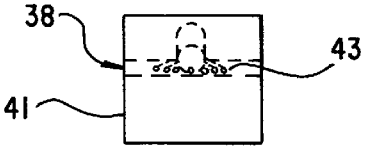
FIG. 4 is a horizontal front sectional view of a spray head.

FIG. 4 shows a front end of tubing holder 38 with spray head 41 having spray head holes 43 through to blind hole 40.

Figure 5:
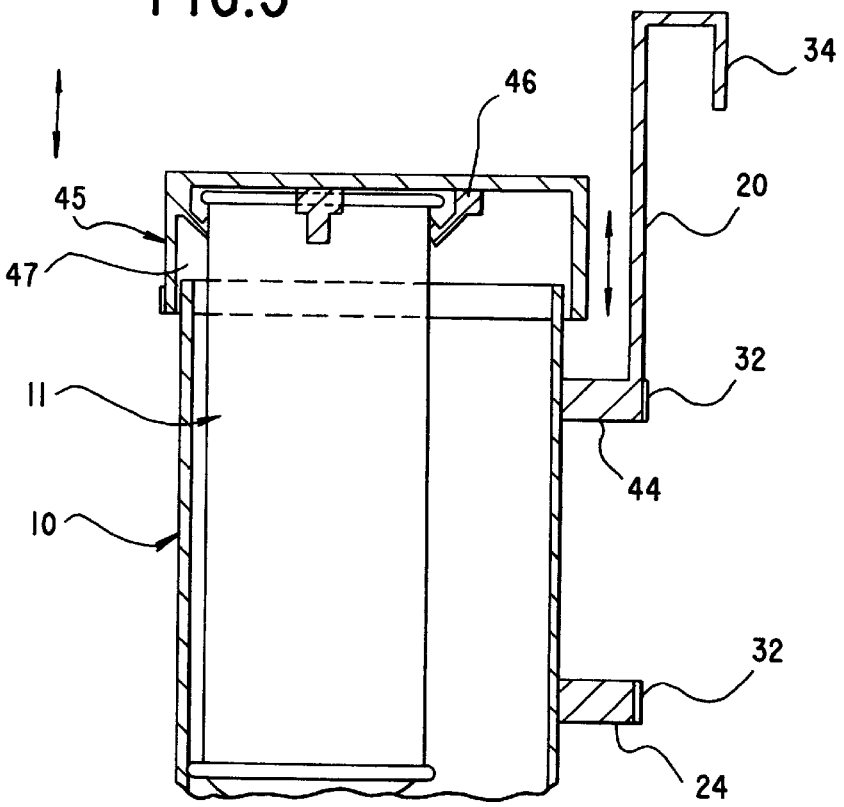
FIG. 5 is a vertical fragmentary sectional side view of the dispenser assembly which does not show the tissue holder.
Figure 6:
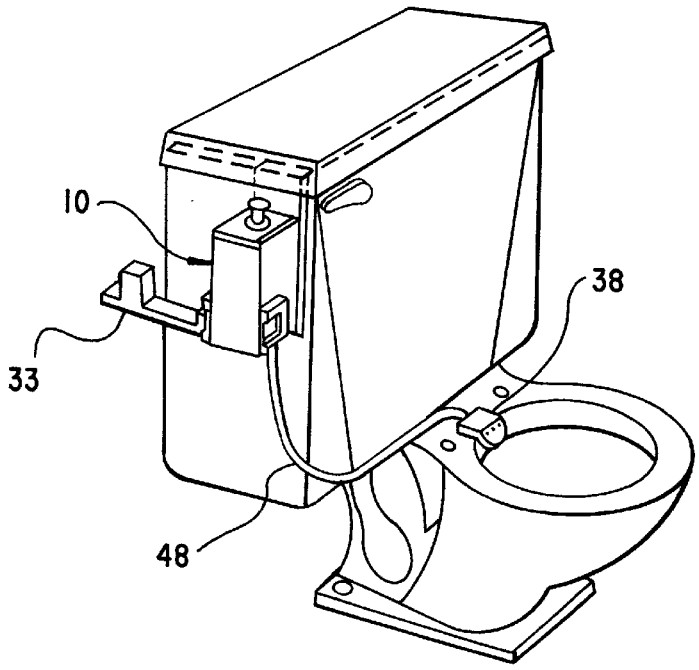
FIG. 6 is a left side view of a toilet with the dispenser assembly installed.

FIG. 5 illustrates an alternate design that will eliminate nine items used in the design shown in FIG. 1. A cover 45 constructed differently from that shown in FIG. 1 has four sides and slides freely over the sides of housing 10. Cover 45 has underside spray can retainers 46 to grip the bottom of the spray can 11 for ease of insertion and retention from within housing 10. Pressure applied to cover 45 will act similarly to the trigger 14 shown in FIG. 1. Spacing 47 indicates the clearance available to activate the spray can before cover 45 bottoms on the open end of housing 10. The size of spacing 47 will also allow for the use of longer spray cans. Other items in this view are the same as shown in FIGS. 1 and 2. FIG. 6. shows the dispenser installed on a toilet and ready for use with tissue holder 33 and with tubing 48 connected to tubing holder 38.

The embodiments of the disclosed invention particularly described herein above are presented merely as examples of my invention. Other embodiments, forms and modifications of the invention coming within the scope and spirit of the noted claims will of course readily suggest themselves to those who are skilled in the art.

I claim:

1. A dispenser for delivering a deodorant into a toilet bowl, the dispenser comprising:

an aerosol spray can containing deodorant and having a nozzle and a bottom end;

a housing having a funnel opening, said housing holding the aerosol spray can so that the nozzle is received into said funnel opening;

a cover pivotally attached to said housing for movement between an open position for replacing the aerosol spray can and a closed position for dispensing the deodorant;

locking means for holding said cover in said closed position;

a trigger disposed in said housing for activating the nozzle of the aerosol spray can by applying pressure to the bottom end of the spray can;

a tube having a first end communicating with said funnel opening and a second end;

a tube holder disposed at a toilet bowl, said tube holder being formed with a plurality of spray holes for delivering the deodorant to the toilet bowl, said plurality of spray holes communicating with said second end of said tube;

a hook attached to said housing for supporting said dispenser from a toilet tank; and a toilet tissue retainer attached to said housing for holding a roll of toilet tissue.

2. A dispenser for delivering a deodorant, from a spray can having a nozzle, into a toilet bowl, the dispenser comprising:

a housing for holding the spray can;

a tube having a first end for communicating with a nozzle of the spray can and a second end;

a tube holder having a plurality of spray holes formed therein communicating with said second end of said tube, said plurality of spray holes being arranged and sized for producing a blanket spray of the deodorant into a toilet bowl; and a trigger, disposed in said housing, for activating the nozzle of the spray can.

3. The dispenser according to claim 2, wherein said trigger comprises a movable side of said housing.

4. The dispenser according to claim 2, wherein said housing includes a hook for supporting said dispenser.

5. The dispenser according to claim 2, wherein said housing includes a toilet tissue retainer for holding a roll of toilet tissue.

6. The dispenser according to claim 2 wherein said housing further includes a hook for supporting said dispenser and a removable toilet tissue retainer for holding a roll of toilet tissue, and in which said trigger comprises a movable side of said housing.

* * * * *